United States Patent [19]

Weber

[11] Patent Number: 4,735,406

[45] Date of Patent: Apr. 5, 1988

[54] MACHINE FOR MAKING BROCHURES AND THE LIKE

[75] Inventor: Walter Weber, Brittnau, Switzerland

[73] Assignee: Grapha-Holding AG, Hergiswil, Switzerland

[21] Appl. No.: 868,261

[22] Filed: May 28, 1984

[30] Foreign Application Priority Data

Jun. 4, 1985 [CH] Switzerland ..... 02354/85

[51] Int. Cl.[4] ..... B42B 1/02

[52] U.S. Cl. ..... 270/53; 54/58

[58] Field of Search ..... 270/53–58, 270/37; 227/99–106, 39–40, 41, 46, 49–50

[56] References Cited

U.S. PATENT DOCUMENTS

| | | | |
|---|---|---|---|
| 389,147 | 9/1888 | Heyl | 270/37 |
| 1,791,081 | 2/1931 | Seiter | 270/53 |
| 3,799,862 | 8/1965 | Muller | 270/54 |
| 3,951,399 | 4/1976 | Reist | 270/58 |
| 4,041,883 | 8/1977 | Meratti et al. | 270/53 |
| 4,079,928 | 3/1978 | Weschenfelder et al. | 270/55 |
| 4,080,678 | 3/1978 | Muller | 270/53 |
| 4,085,927 | 4/1978 | Muller | 270/54 |
| 4,116,427 | 9/1978 | Muller | 270/54 |
| 4,124,203 | 11/1978 | Muller | 270/55 |
| 4,133,521 | 1/1979 | Muller | 270/55 |
| 4,299,378 | 11/1981 | Muller | 270/54 |
| 4,350,327 | 9/1982 | Muller | 270/54 |
| 4,491,311 | 1/1985 | Glanzmann | 270/54 |
| 4,511,132 | 4/1985 | Muller | 270/58 |
| 4,519,599 | 5/1985 | Mayer | 270/53 |

FOREIGN PATENT DOCUMENTS

| | | | |
|---|---|---|---|
| 95603 | 12/1983 | European Pat. Off. . | |
| 2631058 | 1/1978 | Fed. Rep. of Germany . | |
| 660854 | 5/1979 | U.S.S.R. | 270/37 |

*Primary Examiner*—E. H. Eickholt

*Attorney, Agent, or Firm*—Peter K. Kontler

[57] ABSTRACT

A machine for accumulating folded sheets into brochures wherein the sheets are stapled to each other along fold lines has a rotary transporting device with several axially parallel saddle-like carriers for opened sheets and pushers which advance the sheets along their carriers into the range of a stapling device. The sheets are fed to the carriers at two or more stations which are spaced apart from one another in the axial direction of the transporting device and open the sheets shortly before the sheets reach the respective carriers so that each sheet which is deposited at the first station directly straddles its carrier and each sheet which is deposited at a next station directly straddles the previously deposited sheet. the stapling device has several stapling units which perform a pendulum movement about the axis of the transporting device and are operated to simultaneously apply staples to two or more brochures.

27 Claims, 4 Drawing Sheets

MACHINE FOR MAKING BROCHURES AND THE LIKE

BACKGROUND OF THE INVENTION

The invention relates to machines for making brochures and like accumulations of folded sheets. Machines to which the present invention pertains include those known as gather-stitchers wherein one or more staples are used to connect the backs of accumulated folded sheets to each other.

Presently known gather-stitchers operate with drum-shaped singularizing devices which remove successive sheets from a stack by grasping the folded backs of individual sheets. The backs of the withdrawn sheets are caused to strike an abutment, and the thus oriented sheets are opened up by pairs of drums which engage the front edges of the sheets and accelerate the opened sheets on their way toward a saddle-like chain conveyor or a saddle-like rail whereon the opened sheets are transported past one or more additional sheet-admitting stations and on to a stapling station. The accumulations of stapled-together sheets are ejected from the machine by moving them transversely of the direction of travel along the conveyor or along the rail and by depositing them on one or more belt conveyors.

A drawback of conventional gather-stichers and similar machines is that their output is limited because each and every sheet must be individually transported through the machine so that a higher output can be achieved only by increasing the speed of individual sheets. Moreover, only a fraction of a machine cycle is available for the treatment of sheets, such as opening, stapling and ejecting. The speed of individual sheets cannot be increased at will, especially since each sheet is caused to abruptly change the direction of its movement as soon as it reaches the conveyor or the rail as well as immediately upon completion of the stapling operation. Even the most recent types of presently known gather-stitchers cannot turn out in excess of five brochures or the like per second.

Attempts to increase the output of conventional gather-stitchers and analogous machines include reducing the number of changes in the direction of movement of individual sheets. Reference may be had to German Offenlegungsschrift No. 26 31 058. However, the machine of this German printed publication still exhibits a number of drawbacks, such as the need to completely singularize each and every stack of folded sheets (so that a high output can be achieved only by increasing the speed of advancement of sheets from the feeding stations to the stapling station) as well as the fact that only a small fraction of the machine cycle is available for the application of one or more staples to an accumulation of sheets. Still further, the machine which is disclosed in the German printed publication relies on opening of folded sheets exclusively under the action of gravity and centrifugal force. Such mode of opening is not sifficiently reliable because electrostatically charged sheets or sheets whose folded-over panels adhere to each other under the action of freshly applied printing ink are not likely to be opened up with a required degree of predictability. Therefore, the output of such machines is still below that which is desirable in a modern paper processing plant.

Published European patent application No. 95 603 discloses a machine which is similar to that of the aforediscussed German printed publication except that the saddles resemble the rungs of ladders and are closely adjacent to each other. Even though the panels of opened sheets extend downwardly beyond the saddles, the European application does not disclose any means for stabilizing the downwardly extending panels at elevated speeds of the sheets and/or the manner of stapling the accumulated sheets to each other. As a rule, a reliable stapling operation necessitates the utilization of clinching devices which must be guided with a high degree of accuracy in order to cooperate with the staple applying devices so as to predictably deform the legs of staples upon penetration of the legs through the accumulations of sheets at the stapling station. The downwardly extending panels are likely to flutter while the sheets advance at an elevated speed so that they do not permit for predictable introduction of clinching devices. The provision of clinching devices directly on the saddles would contribute to the initial and maintenance cost of the machine, and the clinching devices would have to be guided with a high degree of precision in order to properly register with the mobile staple applicators at the stapling station.

Swiss Pat. No. 584,153 discloses means for stuffing one or more inner sections into the jackets of newspapers or the like. The jackets are introduced into the pockets of a rotating wheel with their folded backs leading, and the jackets are thereupon moved in the axial direction of the wheel and are opened up to provide room for one or more inserts. Each jacket completes one revolution about the axis of the wheel and is opened up as well as shifted axially during such revolution. The patented machine has sheet opening means only between the jacket feeding and the insert admitting stations. The opening means of the patented machine are not suited for predictable opening of sheets, especially if each sheet is a composite sheet having first and second groups of panels joined to each other along the back of the composite sheet. Still further, the backs of folded sheets in the bottom portions of pockets in the rotating wheel are not accessible to stapling or other sheet connecting devices.

Additional sheet gathering machines are disclosed in commonly owned U.S. Pat. Nos. 4,080,678 and 4,511,132.

OBJECTS AND SUMMARY OF THE INVENTION

An object of the invention is to provide a novel and improved gather-stitcher or an analogous machine whose output exceeds and can be a multiple of the output of a conventional machine.

Another object of the invention is to provide the machine with novel and improved means for manipulating the sheets of brochures and like accumulations of folded sheets on their way from the respective sources to a station where the sheets of an accumulation are stapled or otherwise connected to each other.

A further object of the invention is to provide the machine with novel and improved stapling means.

An additional object of the invention is to provide the machine with a novel and improved sheet transporting, opening and connecting arrangement.

Still another object of the invention is to provide a novel and improved method of transporting, opening, accumulating and connecting folded sheets on their way from discrete sources to the gathering station for finished brochures and like products.

A further object of the invention is to provide a machine wherein a large part of or an entire machine cycle is available for the application of staples or like fasteners.

Another object of the invention is to provide a machine whose output exceeds that of conventional machines even though the sheets need not be transported at an elevated speed such as could cause fluttering and/or other undesirable stray movements of the sheets.

The improved machine is used to accumulate folded sheets into brochures or like products and comprises a sheet transporting device which serves to advance folded sheets in a predetermined direction (preferably along a helical path) and comprises at least two elongated parallel saddle-like or otherwise configurated carriers and discrete conveyor means for each carrier. Each conveyor means comprises pushers or other suitable means for advancing sheets along the respective carrier, and the machine further comprises means for feeding sheets to the carriers so that the sheets straddle the respective carriers. The feeding means comprises a first feeding unit having means for depositing first sheets onto successive carriers in a first portion of the path, and at least one additional feeding unit having means for depositing second sheets over successive first sheets in a second portion of the path downstream of the first portion so that the second sheets straddle the respective first sheets and form therewith accumulations of first and second sheets. The machine further comprises means for connecting (for example, stapling) the sheets of the accumulations to each other in a third portion of the path downstream of the second portion. The depositing means of the feeding units preferably include means for cyclically supplying sheets into the respective portions of the path at predetermined intervals. The connecting means can comprise means for simultaneously stapling the sheets of a plurality of discrete accumulations to each other, i.e., the stapling of sheets which form a first accumulation can take place simultaneously with the stapling of sheets which form one or more additional accumulations. The stapling means can comprise means for applying a single staple or a plurality of staples to the sheets of each accumulation of first and second sheets.

The transporting device can comprise means for rotating the carriers about a predetermined axis (e.g., about a substantially horizontal axis) and for simultaneously moving the sheets on the carriers in parallelism with the axis so that the sheets advance along the aforementioned helical path. The carriers are preferably parallel to the axis. One or more shrouds and/or other suitable means can be provided to hold the sheets on the carriers against stray movements relative to the respective carriers under the action of gravity and/or centrifugal force. The holding means do not prevent those movements of the sheets (e.g., under the action of gravity) which are needed to open up the sheets and to thus enable the sheets to properly ride on the corresponding carriers.

The advancing means can be designed to deliver successive accumulations of sheets only into the third portion of the path, i.e., not beyond the third portion of the path. This can be achieved by properly selecting the paths of travel of the aforediscussed pushers of conveyors which cooperate with the carriers to move the sheets along the carriers from the first feeding unit, to each additional feeding unit and ultimately to the connecting means. The connecting means can comprise two or more discrete staple applicators and means for imparting to the applicators a pendulum movement about the axis which is defined by the transporting device. Means can be provided to synchronously operate two or more staple applicators so that each applicator can apply at least one staple to a discrete accumulation of sheets simultaneously with another applicator.

The sheet feeding units can be provided with means for opening up successive sheets in the respective portions of the path, or with means for opening up the sheets before they reach the respective portions of the path. If the opening means are designed to open up the sheets in the respective portions of the path, each feeding unit can comprise a plurality (e.g., a complete annulus) of pockets, one for each carrier and each mounted for orbital movement about the axis in the respective portion of the path, and means for supplying folded sheets into successive pockets of the annulus. Such sheet feeding units further comprise discrete opening means for each pocket, and each discrete opening means can effect the transfer of sheets from the pockets to the respective carriers. The carriers can be mounted on a hub which forms part of the transporting device and rotates about the aforementioned axis. In accordance with a presently preferred embodiment of the invention, the carriers are equidistant from one another in the circumferential direction of the hub. Each pocket has a wide inlet which is remote from the axis and a narrower outlet which is nearer to the axis and is preferably adjacent the respective carrier. Such feeding units can comprise stationary cam means and the opening means can be provided with followers which track the respective cam means.

The connecting means can comprise at least one mobile staple applicator at one side of the third portion of the path and a mobile staple clinching device at the opposite side of the third portion of the path. Such connecting means can further comprise a stationary cam for the clinching device, and the latter is then provided with follower means to track the cam.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
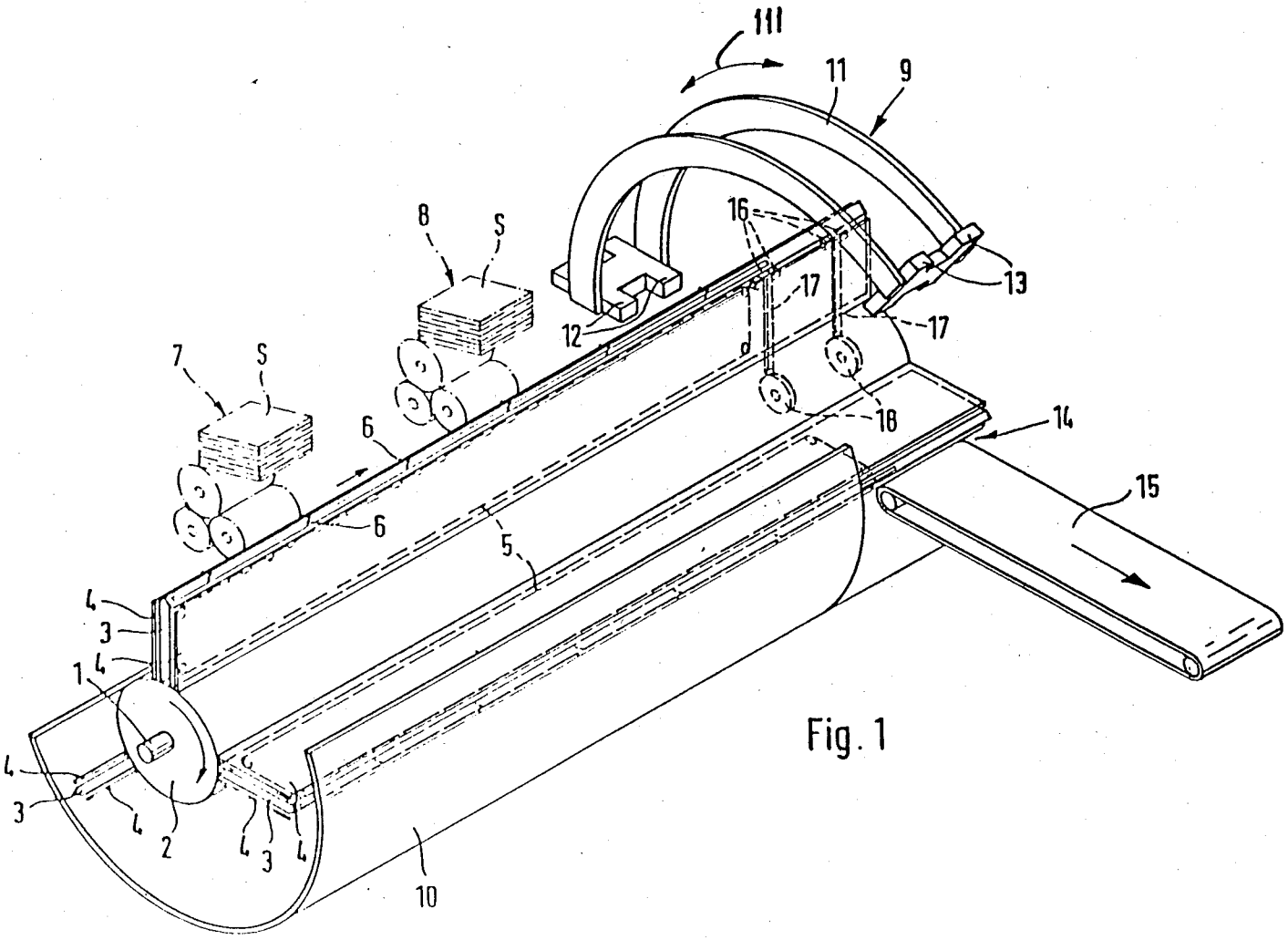
FIG. 1 is a schematic perspective view of a machine with three saddle-like carriers which embodies one form of the invention.

FIG. 1 shows a machine wherein a transporting device includes a stationary horizontal shaft 1 for a rotary hub 2 which supports and rotates three equidistant axially parallel straight elongated saddle-like carriers 3. The means (e.g., a variable-speed electric motor) for rotating the hub 2 about the axis of the shaft 1 is not specifically shown in the drawing. The machine operates cyclically in such a way that the hub 2 rotates through 120 degrees during each cycle, i.e., that the hub completes a full revolution while the machine completes three successive cycles.

The carriers 3 are flanked by pairs of plate-like guides 4 which can be made of sheet metal and confine the panels of folded sheets S which are manipulated in the machine while the sheets straddle the respective carriers 3 so that the folded back of each sheet is outwardly adjacent the ridge of the corresponding carrier 3. The guides 4 are designed to prevent uncontrolled further spreading or opening of sheets S which ride on the corresponding carriers 3.

Each carrier 3 cooperates with a discrete endless chain conveyor 5 having a series of equidistant advancing elements in the form of pushers 6 which serve to advance the sheets S along the respective carriers from a first station which is occupied by a first sheet feeding unit 7, toward, past and beyond a second station which is occupied by a second sheet feeding unit 8, and on to a third station which is occupied by a connecting apparatus 9. During advancement with the pushers 6, the sheets S travel along a helical path whose axis coincides with the axis of the shaft 1. The feeding units 7 and 8 may be of the type disclosed in U.S. Pat. No. 3,199,862 whose disclosure is incorporated herein by reference, the same as the disclosures of all other mentioned U.S. patents and of the copending patent application Ser. No. 682,918, now U.S. Pat. No. 4,614,290. The sheet feeding units 7 and 8 have means for opening the folded sheets S prior to entry of such sheets into the respective portions of the helical path, preferably while the sheets are in the process of moving into actual contact with the selected carriers 3. Each of the sheet feeding units 7 and 8 further comprises means for drawing a discrete sheet S from a stack of such sheets during each cycle of the machine so that each of the three carriers 3 receives a single first sheet S from the feeding unit 7 and a single second sheet S from the feeding unit 8 during each complete revolution of the hub 2. The arrangement is such that the withdrawing means of the units 7 and 8 withdraw successive lowermost sheets S from the respective stacks. The sheets S which are delivered by the opening means of the unit 8 straddle the sheets S which are delivered by the opening means of the unit 7 so that each carrier 3 advances an accumulation of two sheets S which ultimately reach the station for the sheet connecting apparatus 9. Each sheet S can constitute a composite sheet having several pairs of mutually inclined panels at the opposite sides of the ridge of the respective carrier 3.

Sheet feeding units which can be used in the machine of FIG. 1 are further disclosed in commonly owned U.S. Pat. Nos. 4,085,927, 4,491,311, 4,299,378 and 4,350,327.

The number of sheet feeding units can be increased to three or more, depending on the nature of products which are to be formed. Each pusher 6 advances from the sheet feeding unit 7 to the sheet feeding unit 8 or from the sheet feeding unit 8 to the connecting apparatus 9 during each complete revolution of the hub 2. An arcuate trough-shaped shroud 10 is provided to hold the sheets S on the carriers 3 against undesirable movements under the action of gravity and/or centrifugal force. The backs of sheets S on the carriers 3 slide along the concave inner side of the shroud 10 during a certain stage of each revolution of the hub 12. The shroud 10 extends all the way to the connecting apparatus 9 which comprises two staple applicators 12, 13 mounted on a yoke 11 which is caused to perform a pendulum movement about the axis of the shaft 1 as indicated by the arrow 111. The means for moving the yoke 11 relative to the shaft 1 is not shown in FIG. 1; such moving means can be identical with or analogous to the moving means 34 shown in FIG. 2. The staple applicators 12, 13 are angularly offset relative to each other by 120 degrees in the circumferential direction of the hub 2, and each of these applicators has means for applying two staples so that the sheets of each brochure are secured to each other at two spaced-apart locations as seen in the longitudinal direction of the back. It is clear that the illustrated applicators 12, 13 can be replaced with simpler applicators each of which is designed to apply a single staple, or with more complex devices for simultaneous application of three or more suitably spaced-apart staples. The yoke 11 is rocked back and forth at a speed such that, during the application of staples, the applicators 12 and 13 move with and at the exact speed of the hub 2 and carries 3 (about the axis of the shaft 1).

FIG. 1 shows that the pushers 6 are caused to travel along paths which terminate at the station for the connecting apparatus 9. Thus, each oncoming pusher 6 advances an accumulation of sheets S into the range of the staple applicator 12 or 13, and such pusher thereupon reverses the direction of its movement and is caused to advance back toward the station for the sheet feeding unit 7. Each accumulation which reaches the station for the connecting apparatus ceases to move axially of the shaft 1 but continues to orbit around the axis in a clockwise direction as seen in FIG. 1. Such movement is shared by the applicator 12 or 13 which is caused to apply a pair of staples whose legs penetrate through the backs of sheets in the respective accumulation and are upset by associated clinching devices 16 which are adjacent to the inner side of that portion of the path of sheets S which is adjacent the connecting apparatus 9. The clinching devices 16 have radially extending followers 17 which track stationary cams 18 mounted on or adjacent the respective end of the shaft 1 so that their axes coincide with the axis of the hub 2. The shroud 10 has an opening (e.g., a suitably configurated cutout) which allows the finished products in the form of brochures B (see FIG. 4) or the like to leave the respective carriers 3 at an ejecting station 14 by gravity and/or under the action of centrifugal force and to descend onto an endless belt conveyor 15 for transport to storage or to a further processing station. The machine of FIG. 1 comprises two mobile clinching devices 16 for each of the carriers 3, and such pairs of clinching devices are disposed in the respective carriers so that they share the orbital movements of the carriers about the axis of the shaft 1. The exact construction of the applicators 12, 13 and of the associated clinching devices 16 forms no part of the present invention. Reference may be had to U.S. Pat. No. 4,614,290 and to Swiss Pat. No. 549,443.

The number of carriers 3 can be reduced to two or increased to three or more without departing from the spirit of the invention. The carriers 3 are preferably equidistant from each other in the circumferential direction of the hub 2, and the machine is operated in such a way that it completes a cycle during the interval which is required to move the hub 2 through an angle of 360°/n wherein n is the number of carriers on the hub. The speed of rotation of the hub 2 can be reduced proportionately with the increasing number of carriers. The same applies for the speed of the conveyors 5, i.e., the speed of the pushers 6 can be reduced by increasing the number of carriers 3.

Figure 2:
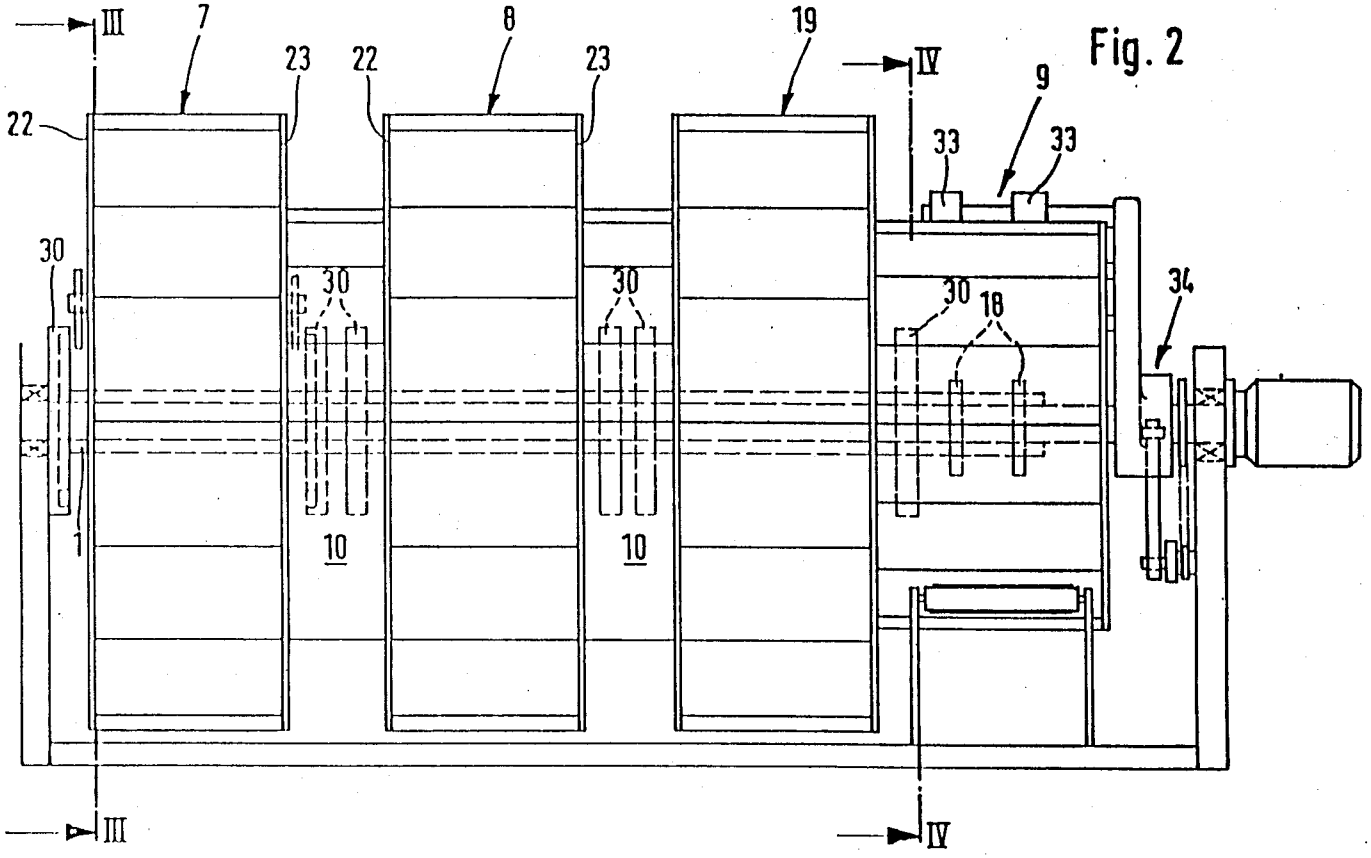
FIG. 2 is a side elevational view of a second machine.
Figure 3:
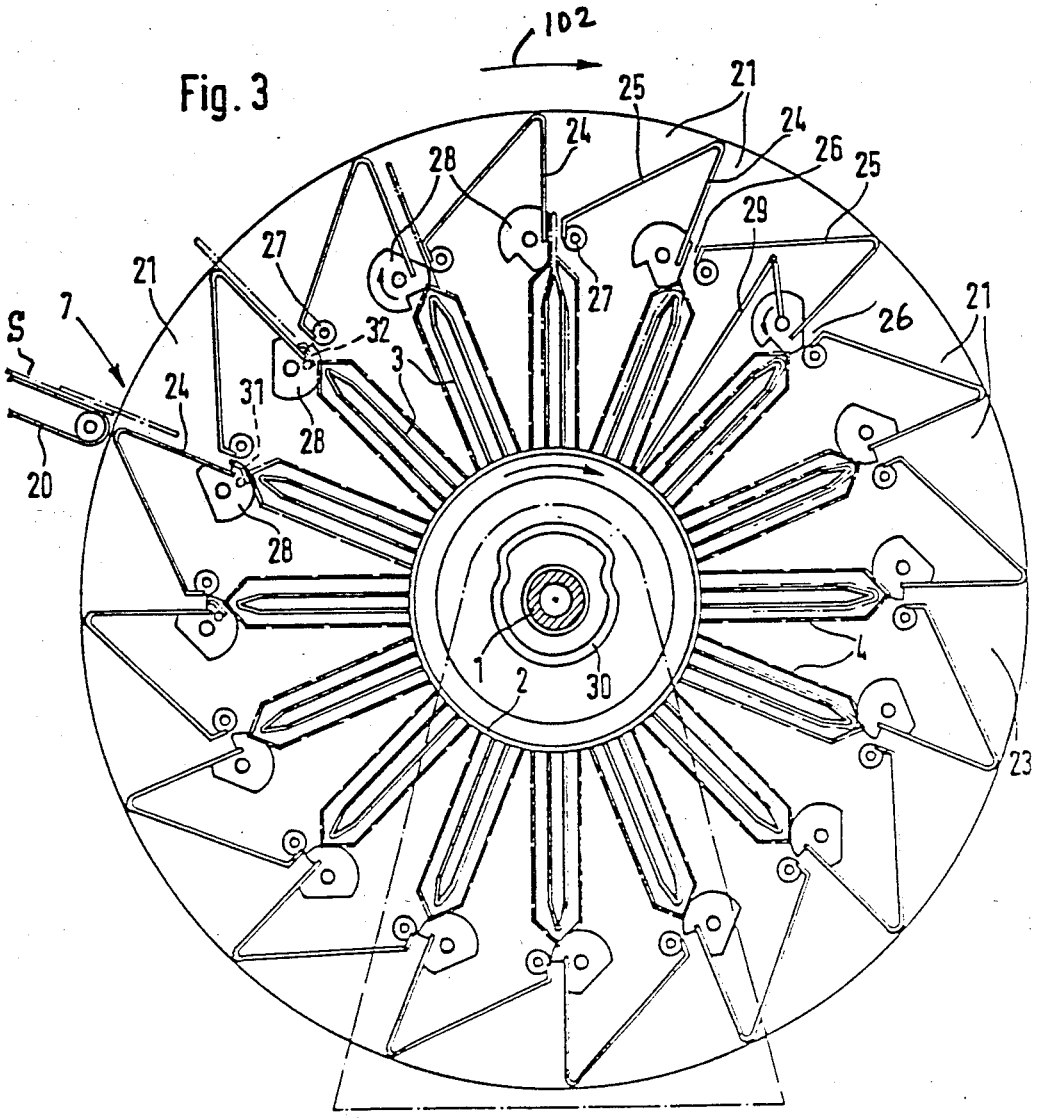
FIG. 3 is a transverse sectional view as seen in the direction of arrows from the line III—III of FIG. 2.
Figure 4:
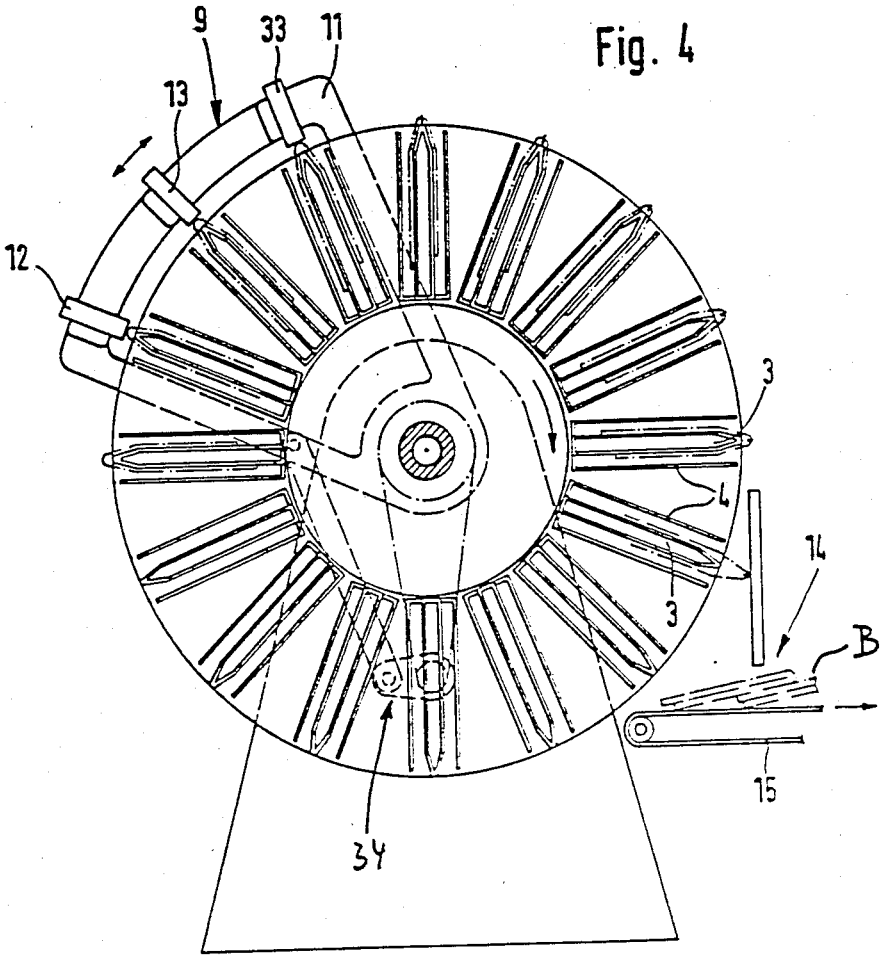
FIG. 4 is a transverse sectional view as seen in the direction of arrows from the line IV—IV of FIG. 2.

The machine of FIGS. 2 to 4 has three sheet feeding units 7, 8 and 19 which are adjacent to three successive portions of the helical path of movement of sheets S toward the sheet connecting apparatus 9. The hub 2 of the sheet transporting device rotates about the axis of the shaft 1 and carries sixteen equidistant radially extending axially parallel carriers 3. The guides 4, chain conveyors and pushers (not specifically shown) are identical with or analogous to the parts 4, 5 and 6 of the sheet transporting device 1–6 in the machine of FIG. 1. The construction of the feeding units 7, 8 and 19 is the same; therefore, FIG. 3 merely shows the details of the sheet feeding unit 7. This unit comprises a belt conveyor 20 which delivers a stream of partially overlapping or non-overlapping folded sheets S toward an annulus of wedge-like pockets 21 which orbit about the axis of the hub 2 and have relatively wide inlets remote from and narrow funnel-shaped outlets 26 nearer to the shaft 1. If the sheets S are supplied in the form of a scalloped stream (as shown in the left-hand portion of FIG. 3), the trailing portion of each preceding sheet S overlies the leader of the next-following sheet. The pockets 21 are defined by pairs of flanges 22, 23 and by sidewalls 24, 25 which extend between the flanges in the axial direction of the shaft 1 and converge toward each other in a direction toward the respective carriers 3. The unit 7 has sixteen pockets 21, one fcr each carrier 3. The trailing sidewall 24 of each pocket 21 extends substantially radially of the flanges 22 and 23.

The outlet 26 of each pocket 21 is flanked by an idler roller 27 and a rotatable drum-shaped opening or spreading device 28. Each opening device 28 has a follower 29 which tracks a stationary cam 30 on the shaft 1. When a pocket 21 reaches the discharge end of the conveyor 20, the corresponding opening device 28 assumes the angular position which is shown above the nine-o'clock position of FIG. 3. A shoulder 31 of the opening device 28 then closes the respective outlet 26 so as to arrest a freshly delivered sheet S which has been lifted off the conveyor 20 by the respective trailing sidewall 24. As the hub 2 rotates in a clockwise direction (arrow 102), the freshly delivered sheet S slides along the respective sidewall 24 and comes into abutment with the shoulder 31 of the corresponding opening device 28. This can be seen at the 10½ o'clock position of FIG. 3. A gripping device 32 is then pivoted into engagement with the wider panel of the sheet S in the pocket 21 to hold the sheet in addition to the shoulder 31. The opening device 28 is then rotated through 90° in a clockwise direction, and the sheet S is pulled radially inwardly by the respective gripping device 32 so that the panel which is held by the gripping device also moves to one side of the respective carrier 3, i.e., the gripped panel is moved away from the other panel of the sheet. The hub 2 continues to rotate in the direction of the arrow 102 and the sheet S reaches the twelve o'clock position of FIG. 3 to be released by the gripping device 32 so that it can descend by gravity and straddles the respective carrier 3. The opening device 28 is then rotated counterclockwise back to its original position in which its shoulder 31 blocks the outlet 26 of the respective pocket 21. Alternatively, the opening device 28 can be rotated clockwise until it completes a full revolution about its own axis and returns its shoulder 31 to a position adjacent the respective outlet 26. Such modification would merely necessitate a relatively simple alteration of means for rotating the opening device 28.

Each sheet S which is taken off the conveyor 20 completes a full revolution (sixteen machine cycles) during movement radially toward the axis of the shaft 1 (so that its panels straddle the respective carrier 3), and the sheet also advances along the carrier toward the station for the next-following sheet feeding unit 8. The conveyor 20 of the unit 8 then admits a second sheet which is manipulated in the same way as the sheet which has been delivered by the conveyor 20 of the unit 7 except that the second sheet comes to rest on the sheet which already straddles the respective carrier 3. A third sheet S is deposited on the second sheet during travel of the respective first and second sheets from the conveyor 20 of the sheet feeding unit 19 toward the station for the connecting apparatus 9 so that each carrier delivers an accumulation of three superimposed sheets wherein the first sheet rides directly on the carrier 3 and the second sheet is disposed between the first and third sheets. The number of sheet feeding units can be increased practically at will, depending on the nature of products whose sheets are to be stapled to each other. The length of the carriers 3 depends on the number of sheet feeding units and on the dimensions of the sheets S. The flange 23 of the sheet feeding unit 7 and the flanges 22, 23 of each of the units 8, 19 have suitable cutouts which enable the conveyors 5 and their pushers 6 to advance sheets S from the unit 7 to the unit 8, thence to the unit 19 and ultimately into the range of stapling means in the apparatus 9. Since the pushers 6 are designed to advance sheets S all the way to but not beyond the station for the connecting apparatus 9, each freshly gathered accumulation (of three sheets each) continues to orbit at the discharge ends of the carriers 3 but does not move axially of the shaft 1 so that it can be properly treated by the staple applicators 12, 13 and 33 as well as by the associated clinching devices (not specifically shown) of the apparatus 9. The applicators 12, 13, 33 are mounted on a support in the form of a yoke 11 which is rocked back and forth by the moving means 34 (see FIGS. 2 and 4) in such a way that the applicators travel with the respective accumulations during advancement of the accumulations toward the ejecting station 14 where the products leave the transporting device and descend onto the belt conveyor 15. The angular spacing between the neighboring applicators 12, 13, 33 (in the circumferential direction of the hub 2) is 22.5° because the transporting device of the machine of FIGS. 2–4 has sixteen equidistant carriers 3. The illustrated connecting apparatus 9 can be replaced with other connecting apparatus, e.g., with an apparatus employing one, two or more rotary stapling heads. The exact manner in which the movements of the applicators 12, 13, 33 and of the associated clinching devices are synchronized with the movements of accumulations of sheets S at the connecting station forms no part of the invention.

Newspaper stuffing apparatus wherein sheets are fed into orbiting pockets are disclosed in commonly owned U.S. Pat. Nos. 4,116,427, 4,124,203 and 4,133,521.

The utilization of a connecting apparatus with two or more staple applicators exhibits the advantage that a longer interval of time is available for the application of staples to discrete accumulations of sheets S during travel toward the ejecting station 14. Such connecting apparatus further contributes to a higher output of the machine, and the output can be increased still further by employing a substantial number of equidistant carriers 3 and means (such as the shroud 10) for holding the sheets S on the carriers 3 against stray movements during travel in the axial direction of the transporting device toward the station for the connecting apparatus. The feature that several staple applicators are mounted on a common yoke 11 or on an analogous support contributes to simplicity of the machine. The feature that the pushers 6 need not advance the accumulations of sheets axially beyond the station for the connecting apparatus 9 contributes to compactness of the improved machine.

The utilization of sheet feeding units of the type shown in FIG. 3 is desirable and advantageous because the opening devices 28 have relatively long intervals of time to open the sheets S during advancement of the sheets from the respective pockets 21 toward and onto the corresponding carriers 3. Furthermore, such sheet feeding units enable the machine to turn out a large number of products per unit of time.

Without further analysis, the foregoing will so full reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A machine for accumulating folded sheets into brochures and like products, comprising a sheet transporting device arranged to advance sheets having folded backs in a predetermined direction along a predetermined path and including at least two elongated parallel carriers and discrete conveyor means for each of said carriers, each of said conveyor means having means for advancing sheets along the respective carrier; and means for feeding sheets to said carriers so that the backs of the sheets straddle the respective carriers, comprising a first feeding unit having means for depositing first sheets onto successive carriers in a first portion of said path and at least one additional feeding unit having means for depositing second sheets over successive first sheets in a second portion of said path downstream of the first portion so that the backs of the second sheets straddle the backs of the respective first sheets and form therewith accumulations of first and second sheets wherein the backs of the second sheets are accessible.

2. The machine of claim 1, wherein the depositing means of said feeding units include means for supplying sheets into the respective portions of said path at predetermined intervals.

3. The machine of claim 1, further comprising means for connecting the sheets of the accumulations of sheets to each other in a third portion of said path downstream of said second portion, including means for stapling the backs of the accumulations to each other.

4. The machine of claim 3, wherein said connecting means includes means for simultaneously stapling the backs of sheets of a plurality of accumulations to each other.

5. The machine of claim 3, wherein said stapling means includes means for applying a plurality of staples to the backs of sheets of each accumulation of first and second sheets.

6. The machine of claim 1, further comprising means for connecting the sheets of the accumulations of sheets to each other, including a plurality of staple applicators and means for operating said applicators in synchronism so that each applicator can apply at least one staple to a discrete accumulation simultaneously with another applicator.

7. The machine of claim 1, wherein said transporting device comprises means for rotating said carriers about a predetermined axis.

8. The machine of claim 7, wherein said carriers are parallel to said axis.

9. The machine of claim 7, further comprising means for holding the sheets on said carriers against movement relative to the respective carriers under the action of gravity and/or centrifugal force.

10. The machine of claim 7, wherein said rotating means comprises a hub and said carriers extend from and substantially radially of said hub, said carriers being equidistant from each other in the circumferential direction of said hub.

11. The machine of claim 7, wherein said advancing means include means for delivering successive accumulations into said third portion of said path.

12. The machine of claim 11, further comprising means for connecting the sheets of the accumulations of sheets to each other in a third portion of said path downstream of said second portion, including a plurality of staple applicators and means for imparting to said applicators a pendulum movement about said axis.

13. The machine of claim 1, wherein each of said feeding units includes means for opening up successive sheets in the respective portion of said path.

14. The machine of claim 13, wherein each of said feeding units comprises a plurality of pockets, one for each of said carriers and each arranged to orbit about said axis in the respective portion of said path, and means for supplying folded sheets into successive pockets, each of said feeding units including discrete opening means for each of the pockets, said opening means including means for effecting the transfer of sheets from said pockets onto the respective carriers.

15. The machine of claim 14, wherein each of said pockets has an inlet remote from said axis and an outlet nearer to said axis and adjacent the respective opening means.

16. The machine of claim 14, wherein said feeding units further comprise stationary cam means and said transfer effecting means include followers tracking the respective cam means.

17. The machine of claim 1, further comprising means for connecting the sheets of the accumulations of sheets to each other in a third portion of said path downstream of said second portion, including means for stapling the backs of the sheets of accumulations to each other, said stapling means comprising at least one mobile staple applicator at one side of the third portion of said path and a mobile staple clinching device at the opposite side of the third portion of said path.

18. The machine of claim 17, wherein said connecting means further comprises a stationary cam for said clinching device and said clinching device comprises follower means tracking said cam.

19. The machine of claim 1, wherein each of said feeding units comprises means for opening folded sheets outside of the respective portion of said path.

20. The machine of claim 1, wherein said path is a helical path.

21. The machine of claim 14, wherein each of said pockets is wedge-shaped.

22. The machine of claim 1, wherein each of said feeding units comprises means for delivering a stream of partially overlapping sheets wherein each preceding sheet overlies the next-following sheet.

23. The machine of claim 22, wherein said delivering means includes means for conveying the sheets of the respective stream with the folded backs constituting the leaders of the sheets.

24. The machine of claim 23, wherein each of said feeding units further comprises means for opening successive sheets of the respective stream including means for engaging the folded backs of the sheets.

25. The machine of claim 24, wherein said transporting device includes means for rotating said carriers and said opening means about a predetermined axis.

26. The machine of claim 1, wherein each of said feeding units includes means for opening folded sheets and said transporting device comprises means for advancing the carriers past said opening means.

27. The machine of claim 1, wherein each of said feeding units includes turnable means for opening folded sheets.

* * * * *

UNITED STATES PATENT AND TRADEMARK OFFICE

CERTIFICATE OF CORRECTION

PATENT NO. : 4,735,406

DATED : April 5, 1988

INVENTOR(S) : Walter WEBER

It is certified that error appears in the above-identified patent and that said Letters Patent are hereby corrected as shown below:

Foremost Page [22] - "1984" should read --1986--.

Signed and Sealed this

Twenty-seventh Day of December, 1988

*Attest:*

DONALD J. QUIGG

*Attesting Officer*

*Commissioner of Patents and Trademarks*